US008640467B2

(12) United States Patent
Bretagne et al.

(10) Patent No.: US 8,640,467 B2
(45) Date of Patent: Feb. 4, 2014

(54) ACOUSTIC POWER TRANSMITTING UNIT FOR THERMOACOUSTIC SYSTEMS

(75) Inventors: Emmanuel Bretagne, Saint Lunaire (FR); Maurice-Xavier Francois, Gif sur Yvette (FR)

(73) Assignees: Universite Pierre et Marie Curie, Paris (FR); Centre National de la Recherche Scientifique, Paris (FR)

( * ) Notice: Subject to any disclaimer, the term of this patent is extended or adjusted under 35 U.S.C. 154(b) by 901 days.

(21) Appl. No.: 11/579,320

(22) PCT Filed: May 3, 2005

(86) PCT No.: PCT/FR2005/050299

§ 371 (c)(1),
(2), (4) Date: Jul. 30, 2008

(87) PCT Pub. No.: WO2005/108768

PCT Pub. Date: Nov. 17, 2005

(65) Prior Publication Data

US 2008/0276625 A1 Nov. 13, 2008

(30) Foreign Application Priority Data

May 4, 2004 (FR) ..... 04 04773

(51) Int. Cl.
*F25B 9/00* (2006.01)

(52) U.S. Cl.
USPC ..... 62/6

(58) Field of Classification Search
USPC ..... 60/516, 517; 62/6, 72.1, 600
See application file for complete search history.

(56) References Cited

U.S. PATENT DOCUMENTS

| | | | | |
|---|---|---|---|---|
| 4,546,733 | A * | 10/1985 | Fukami et al. | 123/184.57 |
| 4,953,366 | A * | 9/1990 | Swift et al. | 62/467 |
| 5,349,813 | A | 9/1994 | Eisinger | |
| 5,489,202 | A | 2/1996 | Eisinger | |
| 5,996,345 | A * | 12/1999 | Hofler | 60/517 |
| 6,021,643 | A | 2/2000 | Gardner et al. | |
| 6,490,871 | B1 * | 12/2002 | Stautner | 62/51.1 |

(Continued)

FOREIGN PATENT DOCUMENTS

GB 1 252 258 11/1971

OTHER PUBLICATIONS

Gardner et al., "A cascade thermoacoustic engine", J. Acoust. Soc. Am. 114 (4), Pt. 1, pp. 1905-1919, Oct. 2003.*

(Continued)

*Primary Examiner* — Frantz Jules
*Assistant Examiner* — Keith Raymond
(74) *Attorney, Agent, or Firm* — Young & Thompson

(57) ABSTRACT

An acoustic power transmitting unit for thermoacoustic systems includes at least one stage provided with at least two thermoacoustic units each of which includes a regenerator or a stack and two heat exchangers, an acoustic resonator including a tube and containing a fluid and in which a magnetic field having high impedance and low-impedance areas is arranged, wherein certain thermoacoustic units are placed in high dimensionless impedance areas. Each high dimensionless impedance area also includes a thermoacoustic unit, wherein two successive thermoacoustic units are always separated by low dimensionless impedance. The resonator includes a reduced diameter section between each couple of successive thermoacoustic units and each cross-sectional narrowing is associated with at least one by-pass which includes a deviation cavity and makes it possible to deviate the major part of a volume flow rate.

17 Claims, 9 Drawing Sheets

(56) References Cited

U.S. PATENT DOCUMENTS

| | | | | |
|---|---|---|---|---|
| 6,560,970 | B1 * | 5/2003 | Swift | 62/6 |
| 6,578,364 | B2 | 6/2003 | Corey | |
| 6,658,862 | B2 | 12/2003 | Swift et al. | |
| 6,700,338 | B2 * | 3/2004 | Sugimoto et al. | 318/114 |
| 6,865,894 | B1 * | 3/2005 | Olson | 62/6 |
| 7,174,721 | B2 * | 2/2007 | Mitchell | 62/6 |

OTHER PUBLICATIONS

Hu et al., "A high frequency cascade thermoacoustic engine", Cryogenics 46 (2006) 771-777.*

Zhu et al., "Numerical method of inertance tube pulse tube refrigerator", Cryogenics 44 (2004) 649-660.*

De Boer, "Performance of the inertance pulse tube", Cryogenics 42 (2002) 209-221.*

Radebaugh et al., "Proposed Rapid Cooldown Technique for Pulse Tube Cryocoolers", International Cryocooler Conference, Inc., Boulder, CO, 2007.*

Yusuke et al., "Thermoacoustic Stirling Engine using a resonance tube", Symposium on Stirling Cycle, L3278A, vol. 6, 2002.*

Olson J R et al: "A Loaded Thermoacoustic Engine" Journal of the Acoustical Society of America, American Institute of Physics. New Yorkk, US, vol. 98, No. 5, Part 1, Nov. 1, 1995 (Nov. 1, 1995), pp. 2690-2693, XP000540128 ISSN: 0001-4966.

* cited by examiner

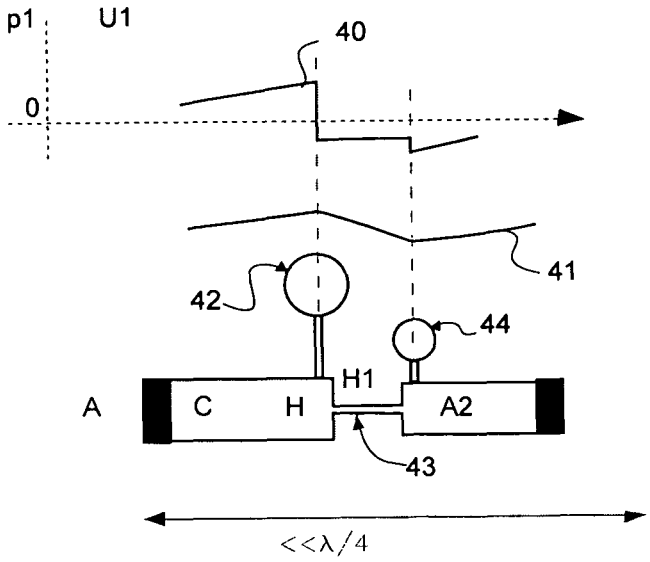
FIG 12A
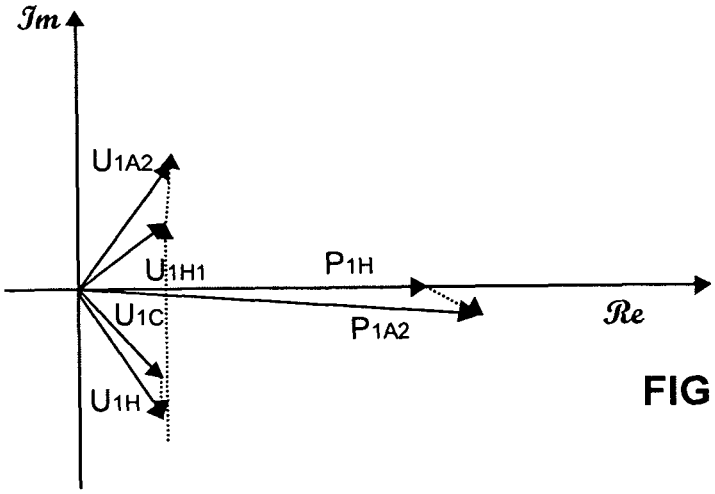
FIG 12B
FIGURE 12

ACOUSTIC POWER TRANSMITTING UNIT FOR THERMOACOUSTIC SYSTEMS

This invention relates to thermal machines, motors and refrigerators employing a process for converting thermo-acoustic energy. In particular, it relates to thermo-acoustic machines of any type encompassing the wave generators and the thermo-acoustic refrigerators, but also the family of the machines of Stirling and of Ericsson and the family of pulsed gas tubes.

Any thermal machine requires at least the presence of two heat sources at different temperatures, of a mechanical work transmission system and of an energy conversion agent undergoing a thermodynamic cycle. In a thermo-acoustic machine, the mechanical work takes on the shape of an acoustic work, expressed more commonly per time unit in terms of acoustic work flux or still acoustic power and corresponding to the temporal mean of the product of the acoustic pressure by the acoustic volume flow rate.

The notion of thermodynamic cycle and hence of energy conversion is the basis of the operation of any thermal machine. In thermal motors, a quantity of heat is converted into acoustic work and in the refrigerators, a quantity of work is consumed for transferring the heat from a so-called <<low>> temperature medium towards a high temperature medium. The power of the thermal machines is linked directly to the <<opening>> of the thermodynamic cycle, i.e. the area formed by this cycle. In most non-acoustic machines, such as a home refrigerator operating according to the thermodynamic cycle of Rankine for example, the conversion agent which describes the thermodynamic cycle is a fluid. This fluid is called <<refrigerant>>, and is circulated via a closed circuit where it is vaporised and condensates.

In thermo-acoustic machines, the conversion agent is generally a gas, typically helium, and the thermodynamic cycle is implemented by an acoustic wave at smaller scale corresponding to that of the displacement of an oscillating fluid particle. It is the co-operation of all the local thermodynamic cycles, cooperation synchronized naturally by the wave itself, which enables energy conversion at global scale of the motor (still called wave generator) or of the thermo-acoustic refrigerator.

In a thermo-acoustic system, the thermodynamic cycle only takes place in the contact zone, or acoustic thermal boundary layer, between the fluid subjected to compression-relaxation phases by the acoustic wave and a solid medium which realises the heat sources necessary to <<the opening>> of the thermodynamic cycle. This fluid/solid interaction at the boundary layer which translates by heat exchanges between the fluid and the solid results from temperature oscillations which accompany any acoustic propagation. This fluid/solid interaction challenges the expandability of the fluid.

In a thermo-acoustic system, according to the type of acoustic field, the local thermodynamic cycles accomplished may be similar to Brayton cycles or even to Ericsson and Stirling cycles.

A first operating type is obtained, so-called 'Brayton' cycle, when the acoustic wave is similar to a rather stationary wave, i.e. having a phase-shift between acoustic pressure and particulate displacement close to 180°, and a second operating type, so-called 'Ericsson or Stirling' type when the wave is rather gradual, i.e. exhibits a phase-shift between acoustic pressure and particulate displacement close to 90°.

The realization of the local thermodynamic cycle requires that thermodynamic transformations succeed to one another in a coordinate way with time. Thus, the heat contributions are such that the fluid of a generator of thermo-acoustic waves performs locally a thermal extension (dilatation) when its pressure is maximum and a thermal contraction when its pressure is minimum.

The thermal extension takes place when the fluid receives heat and reversely.

The synchronisation of thermodynamic transformations which translates an 'arrangement' between the displacement phases, compression-relaxation and extension-contraction of the fluid is realised by the acoustic wave.

The solid medium appears as more or less dense a matrix, relatively uniform enabling good propagation of the acoustic waves inasmuch as the typical dimensions are much smaller than the wavelength corresponding on the acoustic field.

This solid medium is composed of a set of pores or channels, placed in parallel, enabling the passage of a fluid from one end to the other of the matrix. These channels may have quite various shapes, and are not necessarily identical.

This active solid matrix, wherein the fluid oscillates, has necessarily a different aspect characteristic $\delta_\kappa/R_h$ to enable the realisation of both operating types described previously.

$\delta_\kappa$ thickness of the thermal boundary layer and is defined by $$\delta_\kappa = \sqrt{2\frac{\kappa}{\omega}}$$

where $\kappa$ is the thermal diffusivity of the fluid taken at the average temperature of this very fluid and $\omega$ the pulse rate of the acoustic wave. $R_h$ designates the hydraulic radius of the solid matrix taken in the sense of the porous media.

Thus in the first so-called 'Brayton' operating type, $\delta_\kappa$ is of the order of $R_h$ and the solid matrix is then called currently a <<stack>>. In the second so-called 'Ericsson or Stirling' operating type, $\delta_\kappa$ is much greater than $R_h$ and the solid matrix is then called a <<regenerator>>, with reference to the Stirling regeneration machines.

Whereas in a regenerator, good thermal contact is established between the solid elements and the gas, conversely such contact is not good in the stacks.

In the case of a regenerator, the phase-shift between the acoustic pressure and the acoustic speed is close to zero or exhibits a zone where the phase-shift is nil. Conversely in the case of the stack, this phase-shift is always high and close to 90°.

The regenerator just as the stack are members subjected to a stationary temperature distribution, in spite of the oscillating displacement of the fluid, since they are placed between two heat <<sources>>. Consequently, a spatial distribution of heat sources is established exhibiting temperatures intermediate to those of both external heat sources.

A suitable operation, as well of a stack as of a regenerator, requires that they are each placed between two thermal exchangers held at constant and different temperatures in order to constitute a thermal machine. Then, the terms <<stack unit>> or <<regenerator unit>> are used for designating a stack or a regenerator placed between two thermal exchangers.

The temperature distribution as well in a regenerator as in a stack, is imposed in the case of an engine-type operation, by the supply of heat to one of the thermal exchangers of the regenerator unit or of the stack unit. The supply of heat may be obtained from electric, nuclear or solar energy, by combustion, or still by recovery of any thermal waste at appropriate temperature.

These are the local temperature gradients, consecutive to the temperature distribution, which are responsible for the conversion of thermal energy into acoustic energy and thus for the generation of high acoustic power acoustic waves.

In the case of a refrigerator-type operation, the temperature distribution in the regenerator is generated by the acoustic wave.

The stack units may be used in engine-type operation for generating thermo-acoustic power in a thermo-acoustic machine, thereby producing the same effect as an acoustic-mechanical engine but with the advantage of not containing any mechanical moving parts. Still in engine-type operation, the regenerator units may be used for amplifying the flux of acoustic power generated by the engines or by the stack units in an acoustic resonator. Ideally, the amplification ratio of the acoustic power in a regenerator is equal to the temperature ratio of the thermal exchanger where heat is added to that where the non-converted heat is extracted, the temperatures being expressed in Kelvin. In a regenerator, the amplification of the acoustic power flux takes place along the direction corresponding to positive temperature gradients.

In refrigerator-type operation, the stack units and the regenerator units are used indifferently to enable heat extraction from a medium to be cooled. This heat is transferred to a heat exchanger at higher temperature for being evacuated therein. The highest temperature may be selected variably, which exhibits an advantage relative to many refrigeration technologies such as condensation-vaporization refrigeration, for example. It is thus not necessarily close to 293K and may be for example smaller than 200K for cryogenic applications or greater than 500K for applications in high temperature environment.

The selection of a refrigeration unit in the form of a stack unit or of a regenerator unit influences directly the performance coefficient of the unit, still called energy conversion coefficient, which is defined as the ratio of the quantity of heat extracted to the quantity of acoustic work consumed, and the temperature differential between the thermal exchanger at the lowest temperature and the thermal exchanger at the highest temperature.

Thus, according to the theoretic throughputs of the Brayton and Ericsson (or Stirling) cycles, a stack unit does not enable generally to obtain as high a performance coefficient as that of a regenerator unit. Moreover, a regenerator unit is generally better suited to high temperature differentials than a stack unit.

By extension, <<Regenerator unit>>, or <<Extended regenerator unit>> also refer to a regenerator associated with both its exchangers to which are added a tubular section and a third heat exchanger. The tubular section constitutes a volume of buffer gas enabling thermal insulation of the hottest exchanger in the case of an acoustic power amplification unit or the coldest exchanger in the case of a refrigeration unit. The third exchanger placed at one end contributes to the control of the temperature distribution in the tubular section. In this particular embodiment and for an application as a refrigeration unit, the refrigeration unit is then called a <<Pulsed gas tubular unit>>. For stability reasons regarding gravity-induced natural convection effects, the refrigeration unit extends preferably vertically, the exchanger at the highest temperature among the second and third exchangers being placed at the highest altitude.

A thermo-acoustic machine is thus composed of active thermo-acoustic units placed in an acoustic resonator. The resonator has among other things a wave guide role. It may be used at its resonance frequency or not. For example in the case of a source of acoustic energy composed of a loudspeaker, one may select preferably an operating frequency different from the resonance frequency. In the case when the acoustic machine comprises a generator of acoustic waves, the geometry of the resonator conditions strictly the operating frequency $f_{operation}$ of the apparatus.

In a thermo-acoustic machine, the impedance Z is defined as being the ratio between the acoustic pressure $P_1$ and the acoustic speed $u_1$. Each of these two parameters $P_1$ and $u_1$ may be measured locally, one may thus access this impedance Z at each point. The index 1 of each parameter specifies this is an acoustic magnitude, infinitely small of the first order.

The adimensional impedance is the ratio $|Z|/\rho c$ where is $\rho$ the volume mass of the fluid contained in the resonator and c is the speed of the sound in this very fluid and $|Z|$ the module of Z.

It is known that the thermo-acoustic units only operate correctly in zones where the amplitude of the displacements of the particles of fluid is reasonably small and where the amplitude of the acoustic pressure is large.

This amounts to placing the thermo-acoustic units in an adimensional high impedance zone.

An object of this invention is to enable an improvement of the global performances of a thermo-acoustic machine in the thermodynamic sense. In particular this invention proves interesting for the realisation of a thermo-acoustic machine associating one or several pulsed gas tubular sections with a generator of thermo-acoustic waves composed of stack units and of regenerator units.

In a thermo-acoustic machine comprising more than one thermo-acoustic unit, the acoustic power transmission between two stack units, regenerator units or pulsed gas tubular units should, obviously, be maximum for preserving large energetic efficiency for the machine.

Thus, two possible arrangements are known for placing two thermo-acoustic units in an acoustic resonator. These thermo-acoustic units may be placed:

- either consecutively and as close as possible, which necessarily leads to almost integral acoustic power transmission between both units. This first arrangement amounts, for example, to placing the units as a cascade in a same adimensional high impedance zone (seer Gregory W. Swift and al. U.S. Pat. No. 6,658,862).
- or at distinct adimensional high impedance zones, each of these zones being separated by an adimensional low impedance zone. This second arrangement corresponds, for example, conventionally to the placement of a tube of length close to $\lambda/2$ in the acoustic sense between both units, the wavelength $\lambda$ being such that $$\lambda = \frac{c}{f_{operation}}$$

where $f_{operation}$ is the operating frequency of the thermo-acoustic machine. However, this second arrangement leads inevitably to greater acoustic power losses between both units. These losses are substantially linked with the formation of acoustic vortices in the adimensional low impedance zone which is also generally a zone with high acoustic speeds.

The first arrangement seems hence favourable. Nevertheless, taking into account the material space requirements of the thermo-acoustic units, an optimum operation of each of those may not be satisfied perfectly in a same adimensional high impedance zone with more than 3 thermo-acoustic units. It is then necessary to use an extension device of the same adimensional high impedance zone (Swift and al., U.S. Pat. No. 6,658,862). Still this extension device proves inevitably high consumer of acoustic power.

Moreover, this first arrangement exhibits few independent setting parameters. There results that the faulty operation of a single element of the cascade may be quite detrimental to the operation of the assembly.

Obviously, the necessary coordination of the thermo-acoustic units in a same adimensional high impedance zone and therefore the adjustment thereof, becomes more and more complex when the number of thermo-acoustic units, increases. Besides, an additional obstacle to the accumulation of thermo-acoustic units in a same adimensional high impedance zone is the difficulty to guarantee the stability of such a system during an operation in variable conditions (for example, in a geographical zone subjected to high temperature differentials between night and day).

An object of the present invention hence provides a device simple in its design and in its operating mode enabling large acoustic power transmission between each stack unit or regenerator unit, or of pulsed gas tubular section while limiting the energy losses by viscous sinking mechanisms or by enabling to group in a reduced space several consecutive units without degrading their individual performances.

Thus according to the invention, it has been noticed that is possible to place each thermo-acoustic unit at adimensional high impedance zones and to place several, at distinct adimensional high impedance zones, each of these zones being separated by an adimensional low impedance zone.

Another object of the invention is to enable the establishment of acoustic parameters complying with an optimised operation of each thermo-acoustic unit, this being substantially independent from the operation of the adjacent thermo-acoustic units. This adjustment and control possibility introduced by the invention is particularly advantageous when the units are grouped.

The invention thus enables advantageously to reduce the dimensions of such a machine and hence its space requirements.

In this view, the invention relates to a power transmission unit for thermo-acoustic systems including at least one stage, comprising:

- at least two thermo-acoustic units including each a regenerator or a stack and two thermal exchangers,
- an acoustic resonator including a tube and containing a fluid and wherein an acoustic field is established exhibiting adimensional high impedance zones and adimensional low impedance zones,
- certain thermo-acoustic units being placed in adimensional high impedance zones.

According to the invention:

- each adimensional high impedance zone includes at most one thermo-acoustic unit,
- two successive thermo-acoustic units being always separated by an adimensional low impedance zone,
- the resonator includes a section of reduced diameter between each of the couples of successive thermo-acoustic units, and each narrow section is associated with at least one derivation comprising a cavity, said derivation enabling to divert a portion at least of the volume flow rate of the tube.

By "narrow portion" is meant a zone wherein the diameter is reduced with respect to the largest tube diameter of the adimensional high impedance zone.

In different embodiments, the present invention also relates to the following characteristics which should be considered individually or in all their technically possible combinations:

- each narrow section is associated with two derivations, placed respectively at each end of the narrow portion
- the narrow section is continuous;

By "continuous" are meant gradual hop-less variations in opposition to a "discontinuous" variation illustrated by a step.

- the narrow section takes on the shape of a cone;
- the narrow section is discontinuous;
- the narrow section takes on the shape of a step;
- each derivation comprises a conduit connecting the cavity to the tube;
- each derivation includes moreover thermal regulation means enabling to control the flow rate in the derivation;
- resistive systems are associated with one at least of the conduits;
- it includes at least one acoustically active element enabling to adapt the operating conditions of the thermo-acoustic units;
- the acoustically active element is a stack unit placed in the derivated cavity;
- the acoustically active element is a loudspeaker placed in the derivated cavity.

In different possible embodiments, the invention will be described more in detail with reference to the appended drawings wherein.

Figure 2:
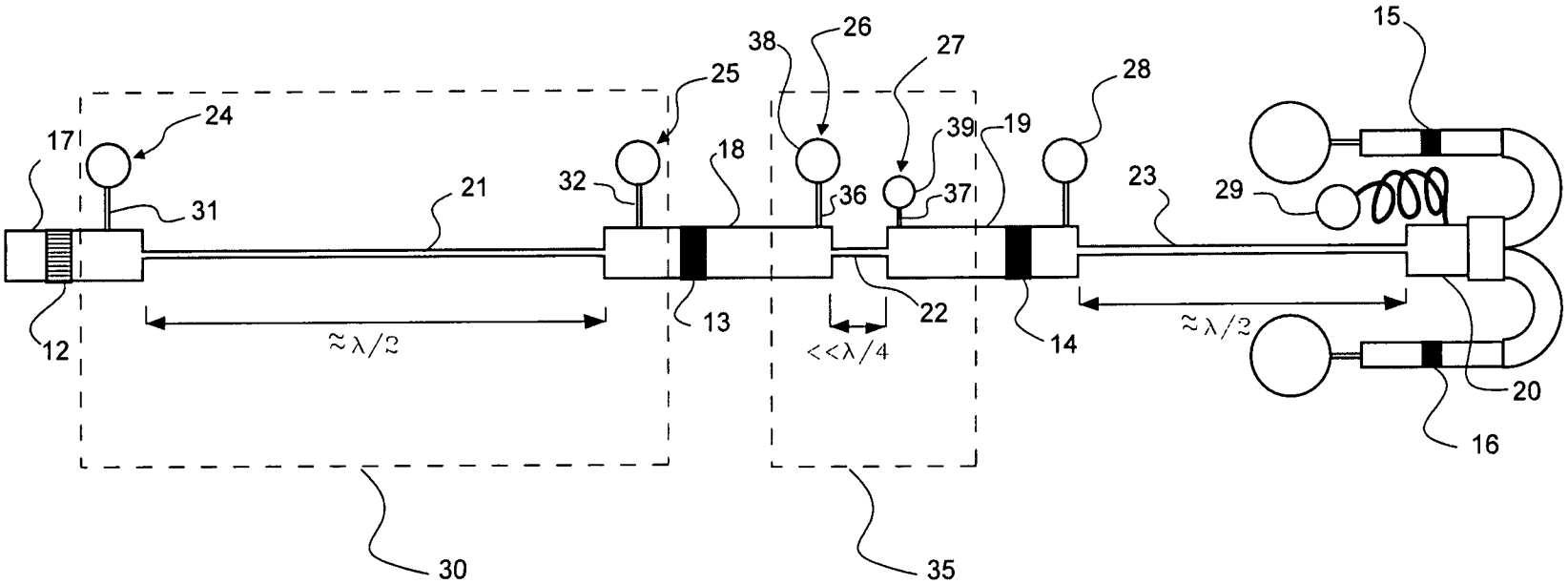
FIG. 2 is a schematic representation of a power transmission and amplification unit for thermo-acoustic systems, according to a second embodiment of the invention.

FIG. 12 is a schematic representation of the evolution of the volume flow rate and of the acoustic pressure in the second tubular section of reduced diameter of the transmission unit of FIG. 2 (FIG. 12A) and FIG. 12B is a schematic representation of the evolution of the amplitude and of the phase of the volume flow rate and of the acoustic pressure in the second tubular section of reduced diameter of the transmission unit of FIG. 2.

Figure 13:
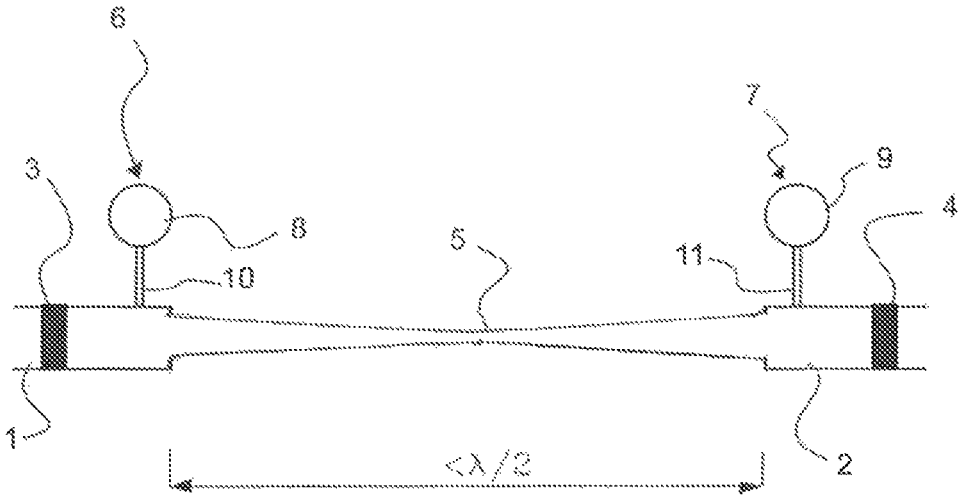

FIG. 13 is a schematic representation of a power transmission unit with narrow section in the shape of a cone.

Conventionally, the power transmission unit for thermo-acoustic systems is integral of an acoustic resonator including a main tube of any geometry and generally of uniform diameter D. This resonator, in combination with the other elements of the device, defines the frequency of the system and the corresponding wavelength.

Figure 1:
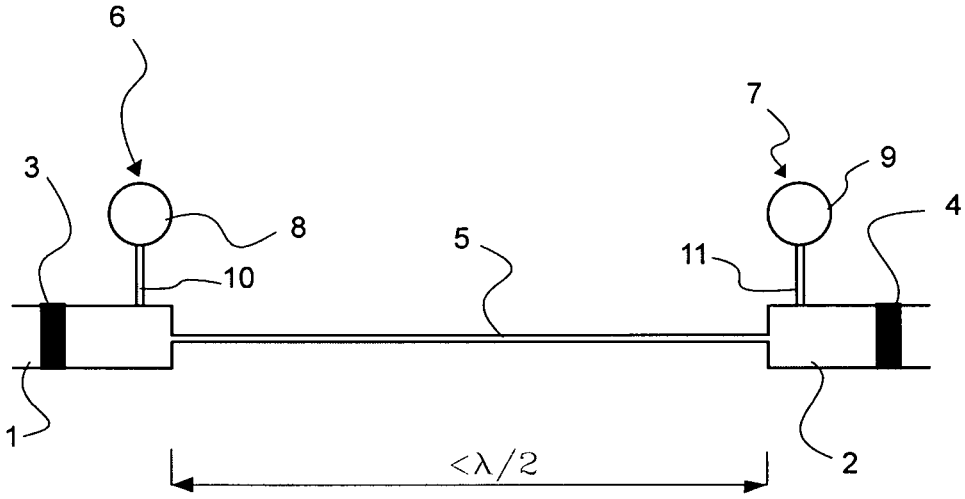
FIG. 1 is a schematic representation of a power transmission unit for thermo-acoustic systems, according to a first embodiment of the invention.

The main tube comprises according to the invention a first 1 and a second 2 element which are linked by a tubular section 5 of reduced diameter d. The ends of the first and second elements 1, 2, connected by said tubular section 5 of reduced diameter, include each a derivated cavity or derivation 6, 7. Each derivation 6, 7 comprises a cavity 8, 9 representing a closed volume linked with a conduit 10, 11, acting on the acoustic characteristics, and in particular on the acoustic volume flow rate, of the main tube (FIG. 1).

Thermo-acoustic cells or units 3, 4 are arranged in the resonator, in adimensional high impedance zones, two successive adimensional high impedance zones being separated by a low impedance zone.

It is known that the derivations 6, 7 enable to modify the acoustic parameters and in particular the volume flow rate at the input (or at the output) of the tubular section of reduced diameter 5.

The invention thus enables to obtain optimum transmission of the acoustic power between each thermo-acoustic unit 3, 4 while maintaining reduced space requirements of the system.

Figure 9:
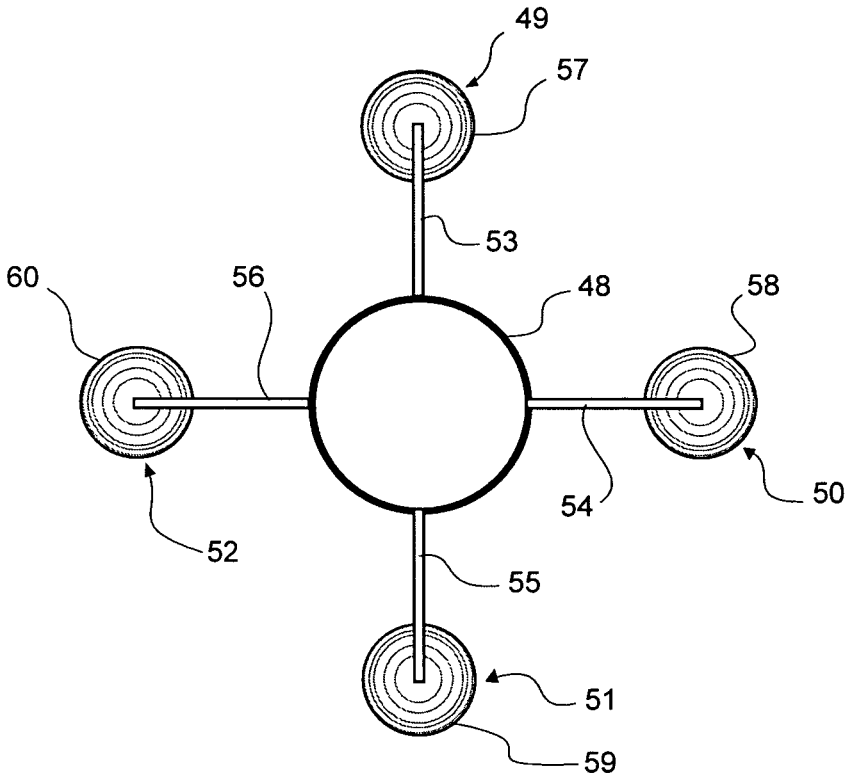
FIG. 9 is a sectional view of a resonator exhibiting multiple derivations according to a particular embodiment.

If the value of the flow rate is very high and that the conditions exposed above haut are difficult to comply with, it is possible to put several derivations 6, 7 in parallel for distributing the initial flow rate (FIG. 9).

Moreover, the section of reduced diameter 5 may be composed of a succession of reduced and increased diameters.

Figure 10:
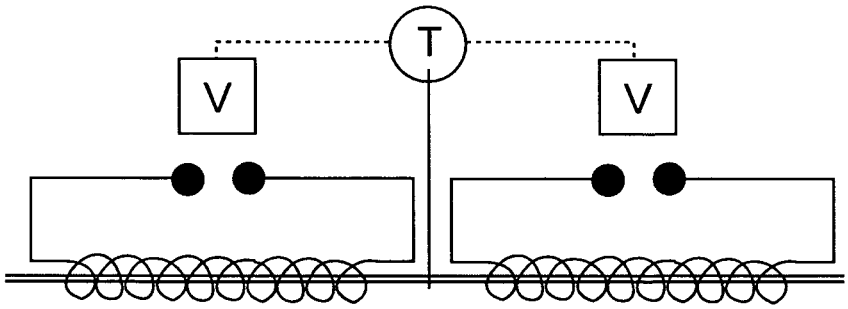
FIG. 10 is a schematic representation of a tubular section of reduced diameter with a temperature control device according to an embodiment of the invention.

The evolution of the flow rate in the section of reduced diameter may be controlled while acting on the local temperature gradient (FIG. 10).

It is known that the regenerator units have a better energy conversion throughput than the stack units and it is hence recommended to use as far as possible regenerator units to make up a thermo-acoustic machine. The regenerator units require however the introduction of an acoustic power at the end thereof at 'room' temperature, i.e. at the end from which the heat is released outside the machine, and may not be used exclusively in the composition of a thermo-acoustic machine with the exception any source of acoustic power as a stack unit for example.

In the present invention, a preferred embodiment consists in associating cascade units in order to form a machine and thereby provide large amplification of a small power created initially by a small stack unit or a mechanical acoustic source. The low efficiency of the stack in comparison with the regenerators plays thus a negligible part in the total efficiency, the more so because the quantity of power sunk in the transmission between units remains low.

FIG. 2 shows such a power transmission and amplification unit for thermo-acoustic systems in a second embodiment of the invention. The resonator comprises a stack unit 12 enabling to produce an acoustic power, which will be amplified by the regenerator units 13-14 placed in cascade and used by the "pulsed gas tubular" units 15-16. These thermo-acoustic units 12-16 are each arranged in an adimensional high impedance zone in the resonator and are separated from the adjacent unit by an adimensional low impedance zone. The resonator comprises therefore a set of 4 main tube elements 17-20 of diameter $D_j$ where j=1 to 4, which are linked to one another by sections or tubes of reduced diameter 21-23 which may have different lengths. In the diameter $D_j$ where j=1 to 4 of each main tube, the pass section is kept for the acoustic wave. Indeed, the diameter of the resonator may be larger in order to confine the thermal insulation (ceramic fibre) and the actual pass diameter may correspond to the inner diameter of a coaxial tube, itself of small thickness to limit the thermal conduction effects.

These sections of reduced diameter 21-23 enable to transmit optimally the acoustic power through adimensional low impedance zones, when at least a portion of the acoustic volume flow rate in the main tube element 17-20 has previously been "diverted" in a cavity placed as a derivation 24-29. A cavity placed as a derivation 24-29 is thus visible close to each section changing zone.

In a first embodiment of a conduit element 30 comprising a tubular section of reduced diameter 21 and two derivations 24, 25, said element exhibits a length equivalent in the acoustic sense at $\lambda/2$, where $\lambda$ designates the wavelength of the acoustic wave privileged. By "conduit element of length equivalent in the acoustic sense at $\lambda/2$" is meant that the resonator element ranges between two adimensional high impedance zones and incorporates a section of zero impedance for the acoustic wave privileged.

The resonator comprises a first 17 and a second 18 elements linked at one of the ends thereof by a first tubular section 21 of reduced diameter d (FIG. 2). In order to avoid the creation of acoustic power losses by acoustic vortex in the adimensional low impedance zone, which is also generally a zone with high acoustic speeds, the ends of the first 17 and second 18 elements include each a derivated cavity 24, 25 comprising a conduit 31, 32. Thus, by derivating at least a portion of the volume flow rate present in the main tube 17, 18 in the derivated cavity 24, 25, the device enables to maintain a number of Reynolds Re much smaller than the critical number of Reynolds $R_{ecritical}$ beyond which the acoustic vortex phenomenon appears. This enables simultaneously to reduce linear energy sink, to keep laminar acoustic behavior for the system, as well as to privilege linear modeling.

It is known that the vortex effects in a resonant tube may generate quite significant losses, up to 90% of the set of losses on a length globally equivalent to $\lambda/2$ in the acoustic sense.

It is also known that the acoustic number of Reynolds is defined as $$\mathrm{Re} = \frac{u_1 d}{A\nu}$$

where d is the diameter of the tube, of great length, $\nu$ the cinematic viscosity of the fluid and A the surface area of a tubular section. The critical acoustic number of Reynolds, $\mathrm{Re}_{critical}$, has typically a value ranging between $10^5$ and $10^6$ [S. M. Hino and al.; Journal of Fluid Mechanics 75 (1976) 193-207].

Figure 11:
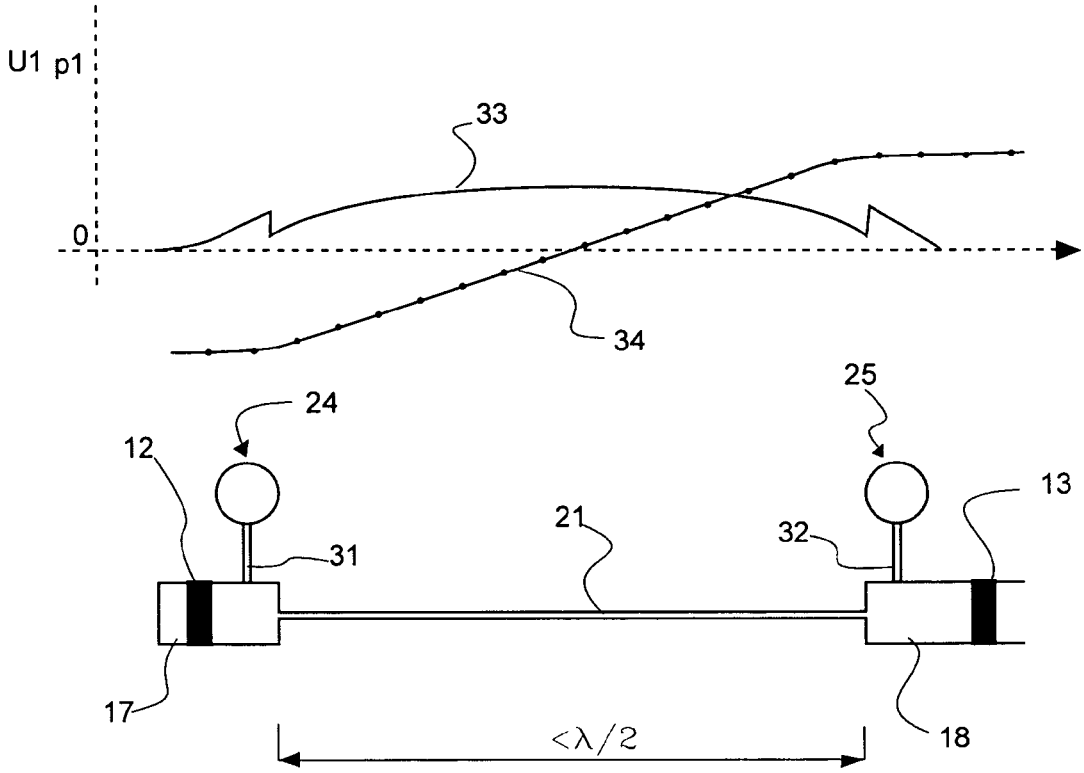
FIG. 11 is a schematic representation of the evolution of the volume flow rate and of the acoustic pressure in the first tubular section of reduced diameter of the transmission unit of FIG. 2.

Reducing the diameter has a negative effect on the dissipation by acoustic vortex except in the sense of the invention for which the volume flow rate $U_1$ is reduced at the inlet of the tube. FIG. 11 shows a typical variation of the volume flow rate in the reduced tube 21 and the effect of the derivated cavities 24, 25 on the reduction in the flow rate in the tube. The first curve 33 (as a full line) shows the evolution of the volume flow rate and the second curve 34 (as a continuous line and circles) shows the evolution of the acoustic pressure in the tubular section of reduced diameter 21 of the transmission unit 30 of FIG. 2. Obviously, the reduction in flow rate in the tube will be adapted to the reduction in diameter which enables to reduce the developed length of the device.

A second possible embodiment of the conduit element 35 comprising a section of reduced diameter and two derivations is represented on FIG. 2, via a second tube 22 of reduced diameter $d_2$ connecting the other end of the second element 18 to a third main tube element 19. The length equivalent in the acoustic sense of this conduit element is much smaller than λ/4, for example it is equal typically to 15% of λ/4. By "conduit element of equivalent length much smaller than λ/4 in the acoustic sense" is meant within the framework of the invention that the resonator element ranges between two high impedance zones and incorporates low impedance sections but never nil for the acoustic wave privileged. Each of the ends of the second 18 and third 19 main tube elements, are connected via a conduit 36, 37 to a corresponding cavity placed as a derivation 38, 39. These cavities 38, 39 and conduits 36, 37 are different since it is thus permitted to adjust independently the operating conditions (i.e. the amplitude and the phase between pressure and acoustic speed) of each regeneration unit 13-16 for recreating, at the inlet of each of these units, operating conditions which are optimum. Advantageously, this tube of reduced diameter 22 enables to create an adimensional low impedance zone over a short tube length, which thus enables to make the power transmission unit compact.

The other end of the third main tube element 19 is connected via a third tubular section 23 of reduced diameter $d_3$ at one end of a fourth tubular element 20. This third tubular section 23 of reduced diameter $d_3$ and the associated derivations 28, 29 form a conduit element of equivalent length to λ/2 on the acoustic plane.

The fourth tubular element 20 which completes the main tube is the refrigerator portion of the thermo-acoustic system. Said portion is composed of two orifice-inertance pulsed gas tubes placed in parallel [Bretagne and al.; "Investigations of acoustics and heat transfer characteristics of thermo-acoustic driven pulse tube refrigerators", In proceeding of CEC-ICMC'03—Anchorage]. Placing in parallel is obtained by the separation of the main tube 20 at its other end into two secondary tubular elements of reduced section. In order to be able to arrange the set of thermo-acoustic units extending in the preferential vertical direction relative to the gravity, the tubes are bent over 180°.

In an acoustic resonator, the acoustic wave privileged may be either imposed when using a non-thermal acoustic power source, or correspond to a preferential acoustic mode of the resonator. When using a thermal acoustic power source, it is mainly the high resistance to the passage of the fluid imposed by the stack units or the regenerator units which determines its acoustic operating mode by imposing the presence of speed nodes (position where the speed is zeroed) in close vicinity of the regenerator units. Consecutively, the regenerator units will impose the presence of high impedance zones. Thus the acoustic mode of the resonator is modified by the absence or the presence of the second 13 and third 14 regenerator units (FIG. 2). The presence of both these regenerator units has generally as a consequence to double the pulse of the acoustic wave privileged.

It is known that the optimum acoustic operating conditions of a regenerator unit correspond to an acoustic volume flow rate in advance with respect to the acoustic pressure at the end at 'room' temperature of the regenerator unit, and delayed at its other end. FIG. 12A illustrates the way the volume flow rate (first curve as a full line and dotted line 40) and the acoustic pressure (second curve as a continuous line 41) vary in an acoustic power transmission unit comprising a conduit element according to the second embodiment, i.e. having an equivalent length much smaller than λ/4 in the acoustic sense.

FIG. 12B explains as a different and more detailed representation (Fresnel diagram) of the evolution of the phases and amplitudes of the pressure and of the volume flow rate between the ends C and $A_2$ of the acoustic power transmission unit and shows that the conditions ensuring the optimum operation of each of the regenerator units are met.

Between C and H the effect is capacitive in the acoustic sense, and the volume flow rate varies according to the first curve 40, and the acoustic pressure is kept globally. A quantity of flow rate is sampled in the first derivation 42 to bring the acoustic volume flow rate at the inlet of the section of reduced diameter 43 in advance with respect to the acoustic pressure. In the section of reduced diameter 43, the effect is inductive in the acoustic sense and the acoustic pressure varies according to second curve 41 and the flow rate is kept. The acoustic flow rate being in advance on the acoustic pressure at $H_1$, this leads to increasing the amplitude of the acoustic pressure along the tube. The second derivation 44 will, this time, restore flow rate and enable to adjust the phase and the amplitude of the flow rate at A2.

The input conditions favourable at the end of the second regenerator are satisfied, i.e. that the volume acoustic flow rate is ahead of the acoustic pressure at A2 and that the amplitude of the acoustic pressure at A2 is greater than that at C, in order to recover sufficient adimensional impedance. Moreover the invention enables advantageously to adjust the phase of the volume flow rate at the end (A2) of the second regenerator independently from its amplitude.

In all cases, between two regenerator units, the use of a conduit element according to the second embodiment will be privileged, i.e. a conduit element of equivalent length much smaller than λ/4 in the acoustic sense, providing it is usable satisfactorily. A detrimental case identified may be, for example, the cascading of too large a number of regenerator units.

The present invention involves correlating the positions of the thermo-acoustic units and of the transmission units which are interlaced between the thermo-acoustic units with the characteristic magnitude Z of the acoustic field in the resonator.

By adimensional high impedance zone is meant a zone which is greater than an order of magnitude 1 and by adimensional low impedance zone the reverse case.

It is known that the stack units and the regenerator units should be arranged in adimensional high impedance zones and typically values close to 5 for a stack unit and close to 30 for a regenerator unit are adopted.

A resonator section corresponding to zero adimensional impedance, may be identified by local measurement of the acoustic pressure and determination of the section where said impedance is negated. An adimensional high impedance zone corresponds to the portion of resonator where the value of the acoustic pressure amplitude in absolute value is maximum (FIG. 11).

Figure 3:
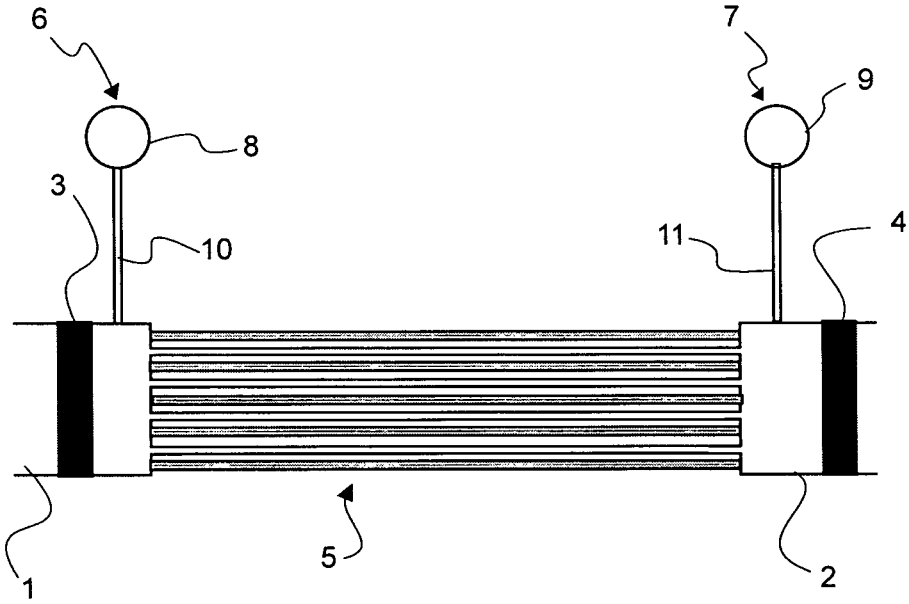
FIG. 3 is a schematic representation of a power transmission unit for thermo-acoustic systems, according to a third embodiment of the invention.

Two main tube elements may also be linked not by a single tube of reduced diameter d but by a plurality of tubes of reduced diameter $d_0$ or of different diameters $d_1$, $d_2$, . . . producing the same effect relative to the power transmission (FIG. 3).

The change in section between the main tube and the tube or section of reduced diameter may be as well discontinuous as continuous. In the first case, it may be a step, in the second, it may take the shape of a cone.

FIG. 3 shows two main tube elements 1, 2 including respectively either a stack unit 3 and a regenerator unit 4, or two regenerator units 3, 4. These thermo-acoustic units 3, 4 are arranged in adjacent adimensional high impedance zones, which are separated by an adimensional low impedance zone. Both main tube elements 1, 2 are linked each at one of their ends by a plurality of tubes 5 of reduced diameter d' parallel to one another and at a derivation 6, 7 comprising a cavity connected 8, 9 to a rectilinear conduit of circular section 10, 11. Such embodiment proves advantageous when the acoustic powers to be transmitted are quite large and when it is necessary to reduce simultaneously the speeds in each of the tubes but also the diameters of each tube in order to avoid any excessive wall thicknesses which are imposed by regulations relative to the apparatus resistance at maximum operating pressure.

Figure 4:
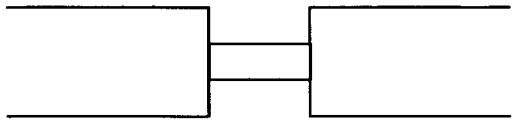
FIG. 4 is a schematic representation of a conduit leading to a derivated cavity according to a first embodiment.
Figure 5:
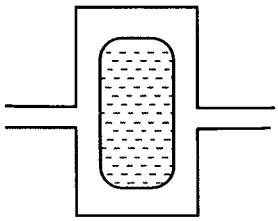
FIG. 5 is a schematic representation of a conduit leading to a derivated cavity according to a second embodiment.
Figure 6:
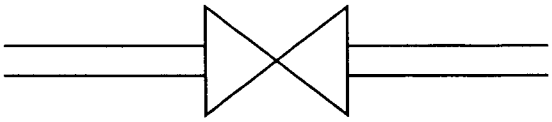
FIG. 6 is a schematic representation of a conduit leading to a derivated cavity according to a third embodiment.

In order to control and to vary the portion of volume flow rate diverted from the main tube element towards the derivated cavity, the conduit leading to the cavity may comprise one or several resistive elements placed in series and acting positively on the phase of the flow rate at the inlet of the derivation. These elements are selected in the group comprising a diaphragm (FIG. 4), a compressible porous medium (FIG. 5) and a resistive valve (FIG. 6) or other.

Figure 7:
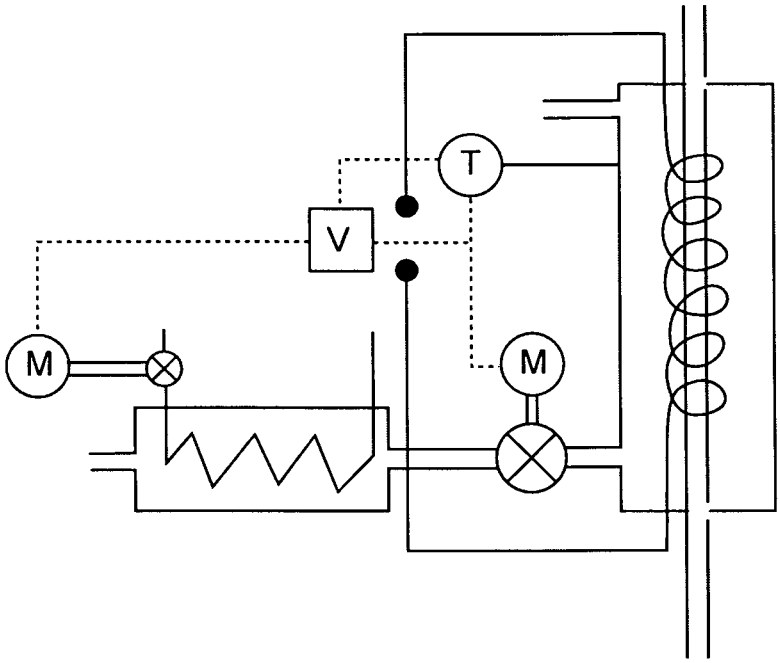
FIG. 7 is a schematic representation of a conduit leading to a derivated cavity with a temperature control device according to a fourth embodiment.

Advantageously, the conduit is temperature-controlled by a heating or cooling effect. To do so, for example, the conduit may be arranged in thermostat-controlled bath whereof the temperature is adjusted either by heating said bath by a heating electric resistor or by cooling using an appended refrigerating group. Electronic temperature control means adjust the temperature relative to a set point (FIG. 7). The temperature control of the conduit enables advantageously non-intrusive adjustment of the acoustic characteristics.

Figure 8:
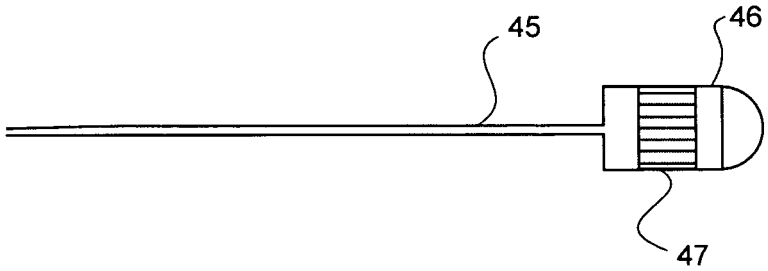
FIG. 8 is a schematic representation of a conduit leading to a derivated cavity, said cavity comprising an acoustically active element according to a fifth embodiment.

FIG. 8 shows a derivation comprising a conduit 45 and a derivated cavity 46. This cavity 46 includes an acoustically active element 47, for example, a stack unit or a loudspeaker enabling mainly active adjustment of the acoustic characteristics at the inlet of the derivation, but also to counteract the losses due to the dissipation, this substantially in the derivation.

It is known that the association of a volume with a conduit such as a thin tube enables to create an easily adjustable resonant cavity and liable to be qualified in the acoustic sense with good approximation relative to the volume of the cavity V and to the section A and length l of the thin tube by the produce:

$$\frac{lV}{ArT}\omega^2,$$

where ω designates the pulse of the acoustic wave and T the average temperature of the gas expressed in Kelvin. For this quantity to be representative, the length of the thin conduit should be smaller than $\lambda/2\pi$ and the inner diameter $d_i$ of this conduit should be such that $d_i/\delta_v >> 1$ with $\delta_v$ the thickness of the viscous boundary layer and where $\delta v = \sqrt{P_r} \times \delta_k$ where $P_r$ is the number of Prandtl.

In the case where the length of the section of reduced diameter is equivalent, in the acoustic sense, at $\lambda/2$, $$\frac{lV}{ArT}\omega^2$$

is preferably greater than 5. On the contrary when this length is much smaller than $\lambda/4$ in the acoustic sense, it is preferable to select $$\frac{lV}{ArT}\omega^2$$

close to 2 but not equal or close to 1, this to avoid sinking whole acoustic power of the main tube in the derivation.

FIG. 9 is a sectional view of a resonator exhibiting multiple derivations in a same section according to an embodiment of the invention. Four derivations 49-52 comprising each a rectilinear conduit 53-56 and a derivated cavity 57-60 are connected to the main tube element 48. To avoid the vibrations in the direction transversal to the axis of the main tube, a preferential embodiment is to arrange the derivations 49-52 by pair in directions directly opposite to one another.

The fields of application of the thermo-acoustic machines are varied and focused on the refrigeration applications. The preferred fields of application of the thermo-acoustic refrigeration machines using as a heat energy source are, among other things, the liquefaction of the industrial or medical gases and the industrial refrigeration.

The invention claimed is:

1. A power transmission unit for thermo-acoustic systems including at least one stage, said thermo-acoustic systems each including an acoustic resonator including a tube and containing a fluid and wherein an acoustic field is established exhibiting adimensional high impedance zones and adimensional low impedance zones, said at least one stage comprising:

a couple of two adjacent tube elements (1, 2; 17, 18; 18, 19; 19, 20) forming two adimensional high impedance zones, each tube element including at most one thermo-acoustic unit (3, 4, 12-16), each thermo-acoustic unit (3, 4) including one of i) a regenerator and two thermal exchangers, and ii) a stack and two thermal exchangers, a section of at least one tube of reduced diameter (5, 21-23) between the couple of said two adjacent tube elements (1, 2; 17, 18; 18, 19; 19, 20), said section of reduced diameter being called a narrow section and forming an adimensional low impedance zone, in the one stage, the narrow section linking two respective adjacent ends of the two adjacent tube elements (1, 2; 17, 18; 18, 19; 19, 20) of the couple, in the thermo-acoustic system, two successive thermo-acoustic units being always separated by a narrow section, wherein, each of the two respective adjacent ends of the two tube elements of the couple includes one of i) one derivation (6, 7; 24, 25; 26, 27; 28, 29) and ii) one set of derivations in parallel (49-52), each derivation comprises a conduit (10, 11) and a cavity (8, 9), the cavity being attached at the end of the conduit, each said derivation (6, 7) is enabling to divert at least a portion of the volume flow rate of the tube element, and each derivation is mounted on the end of the corresponding adimensional high impedance zone contiguous to the corresponding narrow section.

2. A power transmission unit according to claim 1, wherein the narrow section is continuous.

3. A power transmission unit according to claim 1, wherein the narrow section takes on the shape of a cone.

4. A power transmission unit according to claim 1, wherein the narrow section is discontinuous.

5. A power transmission unit according to claim 4, wherein the narrow section takes on the shape of a step.

6. A power transmission unit according to claim 1, wherein each derivation includes moreover thermal regulation means (6, 7) enabling to control the flow rate in the derivation.

7. A power transmission unit according to claim 1, wherein resistive systems are associated with one at least of the conduits.

8. A power transmission unit according to claim 1, further comprising at least one acoustically active element (47) enabling to adapt the operating conditions of the thermo-acoustic units (3, 4, 12-16).

9. A power transmission unit according to claim 8, wherein said acoustically active element (47) is a stack unit placed in the cavity of the derivation.

10. A power transmission unit according to claim 8, wherein said acoustically active element (47) is a loudspeaker placed in the cavity of the derivation.

11. The power transmission unit of claim 1, wherein, each thermo-acoustic unit includes a regenerator and two thermal exchangers.

12. The power transmission unit of claim 1, wherein, each thermo-acoustic unit includes a stack and two thermal exchangers.

13. The power transmission unit of claim 1, wherein, each narrow section (5, 21-23) is associated with at least one set of derivations in parallel (49, 52).

14. A power transmission unit according to claim 1, wherein each narrow section is associated with one derivation (6, 7).

15. A power transmission unit according to claim 1, wherein each narrow section is associated with one set of derivations in parallel (49, 52).

16. A power transmission unit according to claim 15, wherein the derivations of the set are arranged by pairs, and, in each pair, with directions directly opposite to one another.

17. A power transmission unit according to claim 1, wherein, the thermo-acoustic units are only serially cascaded, each unit being linked serially to the adjacent unit by the narrow section.

* * * * *

UNITED STATES PATENT AND TRADEMARK OFFICE

CERTIFICATE OF CORRECTION

PATENT NO. : 8,640,467 B2
APPLICATION NO. : 11/579320
DATED : February 4, 2014
INVENTOR(S) : Bretagne et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1653 days.

Signed and Sealed this
Twenty-second Day of September, 2015

Michelle K. Lee

Michelle K. Lee
*Director of the United States Patent and Trademark Office*